United States Patent [19]

Parsons

[11] Patent Number: 5,016,581

[45] Date of Patent: May 21, 1991

[54] VALVE MECHANISMS

[75] Inventor: Bryan N. V. Parsons, Stoney Stanton, United Kingdom

[73] Assignee: Jaguar Cars Limited, United Kingdom

[21] Appl. No.: 578,785

[22] Filed: Sep. 6, 1990

[30] Foreign Application Priority Data

Sep. 8, 1989 [GB] United Kingdom ..... 8920361

[51] Int. Cl.[5] ..... F01L 1/30

[52] U.S. Cl. ..... 123/90.25; 123/90.16; 123/90.39; 251/232; 74/519; 74/559

[58] Field of Search ..... 123/90.15, 90.16, 90.22, 123/90.23, 90.24, 90.25, 90.26, 90.39; 251/279, 232, 233, 234; 74/519, 559

[56] References Cited

U.S. PATENT DOCUMENTS

| | | | |
|---|---|---|---|
| 1,503,384 | 7/1924 | Sewell | 123/90.25 |
| 1,586,188 | 5/1926 | Fisher | 123/90.25 |
| 2,035,166 | 3/1936 | Kimball | 251/234 |
| 2,035,222 | 3/1936 | Curtis | 123/90.25 |
| 2,954,017 | 9/1960 | Forstner | 123/90.25 |
| 3,952,995 | 4/1976 | Nagumo et al. | 251/232 |
| 4,457,268 | 7/1984 | Jones | 123/90.24 |
| 4,570,900 | 2/1986 | Lonardi et al. | 251/232 |

FOREIGN PATENT DOCUMENTS

| | | |
|---|---|---|
| 420032 | 11/1934 | United Kingdom . |
| 0311282 | 9/1988 | European Pat. Off. . |
| 520733 | 10/1938 | United Kingdom . |

*Primary Examiner*—David A. Okonsky
*Assistant Examiner*—Weilun Lo
*Attorney, Agent, or Firm*—Davis, Bujold & Streck

[57] ABSTRACT

A valve stem which is located for axial movement; a valve lever is pivotally mounted at one end and is attached adjacent the other end to the end of the valve stem, the valve lever defines a track; a drive pin engages in the track the drive pin being mounted at one end of a first link the other end of the link being pivotally mounted about a fixed pivot, a second link is pivotally mounted at one end about moveable pivot, the first and second links being interconnected by an intermediate link pivotally attached to said first and second links at positions separated from their pivots, a drive link is pivotally connected at one end to the pivotal connection between the second link and intermediate link and at the other end to a crank, so that rotation of the crank will cause the linkage to oscillate and the drive pin to perform a reciprocating motion along an arcuate path; the trank has a first portion which is engaged by the drive pin when the valve is closed and coincides with the arcuate path of the drive pin and a second portion which diverges from the path of the drive pin, so that engagement of the second portion by the drive pin will cause the valve lever to move opening and closing the valve; and means being provided for movement of the pivot to vary the timing and duration of opening of the valve.

13 Claims, 2 Drawing Sheets

VALVE MECHANISMS

BACKGROUND TO THE INVENTION

The present invention relates to valve mechanisms and in particular, although not exclusively, to valve mechanisms for internal combustion engines.

SUMMARY OF THE INVENTION

According to one aspect of the present invention, a valve mechanism comprises a valve having a valve stem which is located for axial movement in a valve guide and a valve head adapted, at one extreme of movement of the valve, to locate against and close a valve seat, a valve lever is pivotally mounted at one end and is attached adjacent the other end to the end of the valve stem remote from the valve head, said valve lever defines a track, a drive pin engages in said track, said drive pin being mounted at one end of a first link, the other end of the first link being pivotally mounted at a fixed pivot, so as to constrain the drive pin to move in a fixed arcuate path, a second link is pivotally mounted at one end about a movable pivot, the first and second links being interconnected by an intermediate link pivotally attached to said first and second links at positions separated from their pivots, a drive link being pivotally connected at one end to the second link or the intermediate link at or adjacent the interconnection therebetween and at the other end to a crank, so that rotation of the crank will cause the linkage to oscillate and the drive pin to perform a reciprocating motion along its arcuate path, the track in the valve lever having a first portion which is engaged by the drive pin when the valve is closed and coincides with the arcuate path of the drive pin and a second portion which diverges from the path of the drive pin, so that engagement of the second portion by the drive pin will cause the valve lever to move opening and closing the valve, means being provided for moving the pivot of the second link to vary the timing and duration of opening of the valve.

The mechanism described above provides desmodromic action, the valve lever controlling movement of the valve in both directions. There is consequently no need for the return springs used in conventional poppet valve mechanisms and the inherent disadvantages of such mechanisms, in particular valve bounce, are avoided so that the mechanism may be run at faster speeds. The variation in valve timing achieved by this mechanism may be achieved by varying the closing point of the valve while the opening point remains substantially constant.

BRIEF DESCRIPTION OF THE DRAWINGS

The invention is now described, by way of example only, with reference to the accompanying drawings in which.

DESCRIPTION OF A PREFERRED EMBODIMENT

Figure 1:
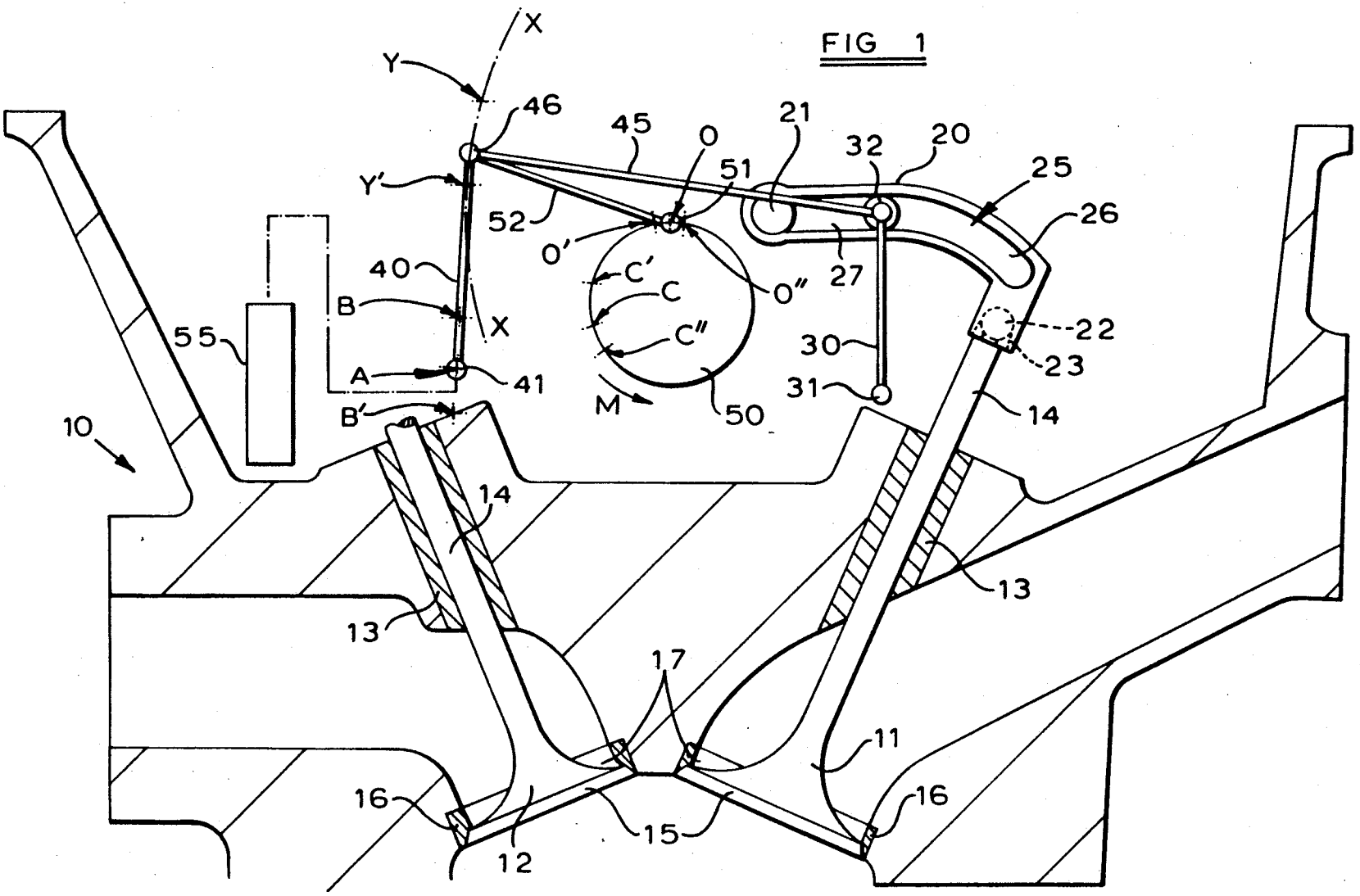
FIG. 1 illustrates diagrammatically a valve mechanism in accordance with the present invention.

FIG. 1 shows in cross-section, a cylinder head 10 with inlet valve 11 and exhaust valve 12, each valve slidably located in a valve guide 13. The valves 11 and 12 comprise a valve stem 14 which engages the valve guide 13 and a valve head 15 which is arranged to engage against a valve seat 16 to close a port 17.

A valve lever 20 is pivotally mounted at one end on pivot 21. A ball formation 22 on the end of valve stem 14 engages in the complementary formation 23 on the end of valve lever 20 remote from the pivot 21, so as to permit limited pivotal movement between the valve member 20 and valve stem 14. Means is also provided .to accommodate thermal expansion of the valve stem 14.

A track 25 is provided on the valve lever 20, said track 25 having an arcuate portion 26 and a linear portion 27.

A first link 30 is pivotally mounted at one end about a fixed pivot 31. A drive pin 32 is mounted on the other end of link 30, the drive pin 32 engaging in the track 25. The separation between the drive pin 32 and pivot 31 is equal to the radius of the arcuate portion 26 of the track 25 and the pivot 31 is located such that when the valve 11 is closed, the pin 32 will move freely around the arcuate portion 26 of the track 25.

A second link 40 is pivotally mounted at one end about a pivot 41. An intermediate link 45 is pivotally connected at one end to the end of link 40 remote from pivot 41, by means of a pivot 46 and at the other end to the end of link 30 which carries a drive pin 32.

A crankshaft 50 is mounted between the links 30 and 40 and a crank 51 thereon is connected to pivot 4 by drive link 52. Rotation of the crankshaft 50, which may be driven in suitable manner from the engine in the direction indicated by arrow M, will thus cause the linkage 52, 40, 45, 30 to oscillate causing drive pin 32 to reciprocate along an arcuate path defined by link 30. While the pin 32 engages the arcuate portion 26 of track 25, the valve will remain closed. However, when the pin engages the linear portion 27 of the track 25, the lever will be moved to open and then close the valve 11. The opening and closing point of the valve 11 will correspond to when the drive pin 32 is located at the junction of the arcuate portion 26 and linear portion 27 of track 25.

Means 55 is provided for adjusting the position of the pivot 41, said adjustment being axially of the link 40 when the linkage 40, 45, 30 is positioned such that the valve 11 is at its opening or closing point. Adjustment of the position of pivot 41 in this manner, will adjust the position of crank 51 relative to the opening and closing point of the valve 11 and thus vary the timing of duration of opening of the valve 11.

For example, as illustrated in FIG. 1 when the pivot 41 is located at position A, the opening and closing points of the valve 11 will correspond to the positions O and C of the crank 51 respectively. If however pivot 41 is moved to position B, at the opening and closing points of valve 11 pivot 46 will move up the arc X—X to point Y and the corresponding positions of the crank 51 will move to O′ and C′. As can be seen, movement of the pivot 41 upwardly (as illustrated) in this manner, will reduce the duration of opening of the valve, the opening point 0 being retarded slightly while the closing point C is advanced to a relatively significant degree.

Similarly, if pivot 41 is moved downwardly (as illustrated) to point B′, pivot 46 will move down the arc X—X to point Y′ and the corresponding positions of crank 51 will move to O″ and C″. The duration of opening of the valve is thus extended, the opening point 0 being advanced slightly, while the closing point C is retarded to a relatively significant degree.

The basic timing of opening and closing of valve 11, the duration of opening and degree of opening are controlled by the geometry of the linkage 30, 40, 45, throw of crank 51 and geometry of lever 20 and the track 25 therein. Variation of this basic timing is achieved by movement of the pivot 41, which will preferably be controlled in response to engine speed in suitable manner, for example by hydraulic or screw adjustment means.

Advantageously variation in duration of opening of an inlet valve is achieved by variation of the closing point while the opening point remains substantially constant. In particular the opening point of inlet valve is preferably varied by up to 20 degrees, while the closing point may be varied by up to 60 degrees. In order to achieve this the angle subtended between the intermediate link 45 and drive link 52, when inlet valve 11 is at its opening point is preferably less than 20 degrees.

Variation in the duration of opening of the exhaust valve is not so critical and the exhaust valve timing may be fixed. However, when it is desirable to vary the timing of the exhaust valve this is preferably done by maintaining the closing point substantially constant and advancing or retarding the opening point. In particular the opening point of the exhaust valve is preferably varied by up to 60 degrees and the closing point varied by up to 20 degrees, the angle subtended between the intermediate link 45 and drive link 52, when the exhaust valve is at its closing point preferably being less than 20 degrees.

The crankshaft 50 may be arranged to control the inlet valves 11 and exhaust valves 12 of other cylinders of the engine through similar mechanisms, the cranks 51 being arranged to provide appropriate phase relationship between the valves. While the inlet valve 11 and exhaust valve 12 of each cylinder may be controlled by similar mechanisms, the variation in timing will normally be different. If it is not necessary to vary the timing of the exhaust valve, the pivot 41 of the mechanism controlling the exhaust valve may be fixed.

Figure 2:
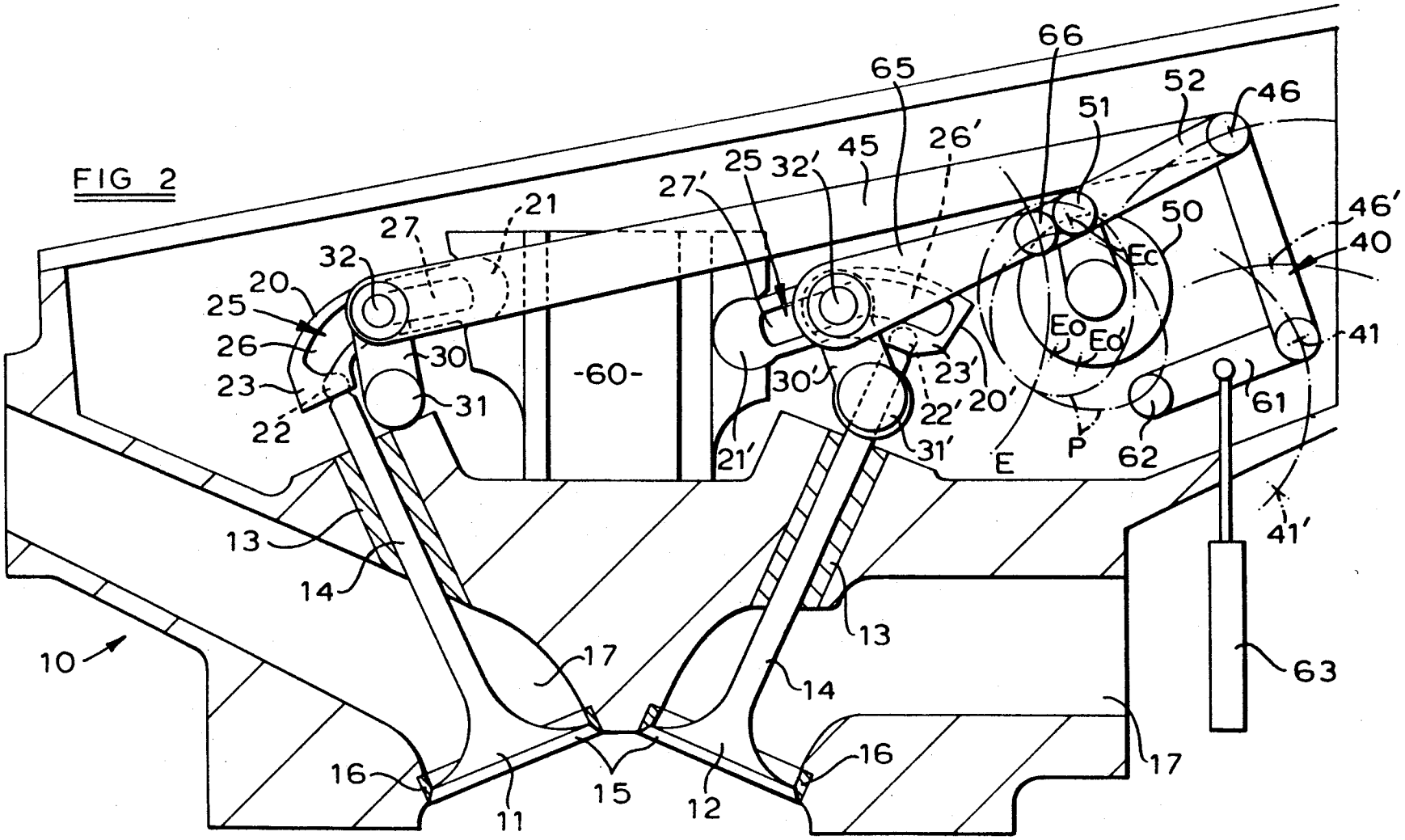
FIG. 2 illustrates an alternative embodiment of the invention.

Alternatively, the inlet and exhaust valves 11, 12 may be controlled by a common crank 51 as illustrated in FIG. 2. In this mechanism, the crankshaft 50 is located on the outside of exhaust valve 12. The crank 51 is drivingly connected to the inlet valve 11 in the manner illustrated in FIG. 1, the valve lever 20 being pivotally supported by post 60 positioned between the valves 11 and 12. The pivot 41 for link 40 is provided at one end of an arm 61 which may be pivotted about pivot 62, by suitable means 63, to vary the position of the pivot 41 and thereby vary the timing of the inlet valve 11, as described above.

A second valve lever 20' is also pivotally attached at one end to the post 60 and is attached to the stem 14 of exhaust valve 12, in similar manner to that in which the inlet valve 11 is attached to valve lever 20. The second valve lever 20' defines a track 25' similar to that defined by lever 20.

A drive pin 32' engages in the track 25', the drive pin 32' being mounted at one end of a link 30', the other end of link 30' being pivotally mounted about a fixed pivot 31', so that the drive pin 32' is constrained to move along an arcuate path. The link 30' is pivotally connected coaxially of the pin 32' to one end of a link 65, the other end of the link 65 being pivotally connected to an extension of the drive link 52 by pivot 66.

As the crank 51 rotates, the pivot 66 will describe an ovoid path P which will cause the pin 32' to move in reciprocating motion in the track 25, opening and closing the exhaust valve 12. The inlet valve 11 is opened and closed in similar manner, as described above. As pins 32 and 32' will move in the same direction while the tracks 25 and 25' are reversed, one valve 11, 12 will be opening as the other valve 12, 11 and closes and vice versa. The relative timing of the inlet and exhaust valves 11 and 12 may be set as desired, by suitable design of the geometry of the linkage mechanism.

As the pivot 41 is moved, the ovoid path P along which pivot 66 moves will swing around as illustrated in broken line in FIG. 2. The opening and closing points of the exhaust valve 12 are represented by the arc E. As the position of pivot 41 is moved, the position of pivot 66 at which the exhaust valve will open, remains substantially constant while the position at which the exhaust valve 12 closes varies. However when the position of crank 51 corresponding to the position of the crank 66 is considered, there is a significant variation in the opening point Eo to Eo' while the closing position Ec remains substantially constant. The opening and closing positions of the inlet valve will vary with the position of pivot 41, as described above. Consequently, movement of the pivot 41 will vary the timing of both the inlet and exhaust valves 11 and 12, the degree to which each is varied depending on the geometry of the linkage mechanism.

Various modifications may be made without departing from the invention. For example, while in the above embodiment the intermediate link 45 is connected to the first link 30 at an point coincident with drive pin 32 and the drive link 52 is connected to the second link 40 at a point coincident with the connection to the intermediate link 45, these connections may be separated in order to provide amplification of movement where desired. Alternatively, the drive link 52 may be connected directly to the intermediate link 45 at a point adjacent the connection between the intermediate link 45 and second link 40.

I claim

1. A valve mechanism comprising a valve having a valve stem which is located for axial movement in a valve guide and a valve head adapted, at one extreme of movement of the valve, to locate against and close a valve seat, a valve lever is pivotally mounted at one end and is attached adjacent the other end to the end of the valve stem remote from the valve head, said valve lever defines a track, a drive pin engages in said track, said drive pin being mounted at one end of a first link, the other end of the first link being pivotally mounted at a fixed pivot, so as to constrain the drive pin to move in a fixed arcuate path, a second link is pivotally mounted at one end about a movable pivot, the first and second links being interconnected by an intermediate link pivotally attached to said first and second links at positions separated from their pivots, a drive link being pivotally connected at one end to the second link or intermediate link at or adjacent the interconnection of said second link and intermediate link and at the other end to a crank, so that rotation of the crank will cause the linkage to oscillate and the drive pin to perform a reciprocating motion along its arcuate path, the track in the valve lever having a first portion which is engaged by the drive pin when the valve is closed and coincides with the arcuate path of the drive pin and a second portion which diverges from the path of the drive pin, so that engagement of the second portion by the drive pin will cause the valve lever to move opening and closing the valve, means being provided for moving the pivot of the second link to vary the timing and duration of opening of the valve.

2. A valve mechanism according to claim 1 in which the second portion of the track is linear.

3. A valve mechanism according to claim 1 in which the means for moving the pivot of the second link moves the pivot in a direction axially of the link when the linkage is positioned such that the valve is at its opening or closing point.

4. A valve mechanism according to claim 1 in which the pivot of the second link is mounted on a pivotted arm, means being provided for movement of the pivotted arm to move the pivot of the second link along an arcuate path.

5. A valve mechanism according to claim 1, in which the pivot of the second link is moved in response to engine speed.

6. A valve mechanism according to claim 1 in which said valve is an inlet valve, movement of the pivot of the second link varying the timing to advance and retard the closing point of said inlet valve whilst the opening point of the valve remains substantially constant.

7. A valve mechanism according to claim 6 in which the opening point of said inlet valve is varied by up to 20 degrees and the closing point of the valve is varied by up to 60 degrees.

8. A valve mechanism according to claim 6 in which the angle subtended between the intermediate link and drive link, when the inlet valve is at its opening point, is less than 20 degrees.

9. A valve mechanism according to claim 1 in which said valve is an exhaust valve, movement of the pivot of the second link varying the timing to advance or retard the opening point of said exhaust valve whilst the closing point of the valve remains substantially constant.

10. A valve mechanism according to claim 9 in which the opening point of said exhaust valve is varied by up to 60 degrees and the closing point of the valve is varied by up to 20 degrees.

11. A valve mechanism according to claim 9 in which the angle subtended between the intermediate link and drive link, when the exhaust valve is at its closing point is less than 20 degrees.

12. A valve mechanism according to claim 1 in which a second valve lever is pivotally mounted at one end and is attached at the other end to the stem of a second valve, said second valve lever defining a track; a second drive pin engaging in the track, the second drive pin being mounted at one end of a link, the other end of the link being pivotally mounted on a fixed pivot so as to constrain the second drive pin to move in an arcuate path; the track in the second valve lever being contoured so that one portion coincides with the path of the second drive pin and a second portion diverges from the path of the second drive pin when the second valve is closed, whereby when the second drive pin engages the second portion of the track, it will cause the second valve lever to move and open the second valve; and a link being pivotally connected at one end to the link carrying the second drive pin and at the other end to an extension of the drive link at the end of the drive link connected to the crank.

13. A valve mechanism according to claim 12 in which said valve is an inlet valve and said second valve is an exhaust valve.

* * * * *